United States Patent [19]

Schöpwinkel et al.

[11] Patent Number: 4,630,336

[45] Date of Patent: Dec. 23, 1986

[54] APPARATUS FOR GATHERING A FIBER WEB INTO A SLIVER IN A CARDING MACHINE

[75] Inventors: Theo Schöpwinkel; Wilfried Weber, both of Monchen-Gladbach, Fed. Rep. of Germany

[73] Assignee: Trützschler GmbH & Co. KG, Monchen-Gladbach, Fed. Rep. of Germany

[21] Appl. No.: 635,259

[22] Filed: Jul. 27, 1984

[30] Foreign Application Priority Data

Jul. 30, 1983 [DE] Fed. Rep. of Germany ..... 3327574

[51] Int. Cl.[4] ..... D01H 13/04

[52] U.S. Cl. ..... 19/288; 19/150; 19/291

[58] Field of Search ..... 19/288, 291, 150, 106 R, 19/292

[56] References Cited

U.S. PATENT DOCUMENTS

| | | | |
|---|---|---|---|
| 2,272,787 | 2/1942 | Bentley | 19/291 |
| 2,357,982 | 9/1944 | Thomas et al. | 19/291 X |
| 3,246,370 | 4/1966 | West | 19/150 |
| 3,401,429 | 9/1968 | Whitehurst | 19/150 X |
| 3,432,891 | 3/1969 | West . | |
| 4,213,553 | 7/1980 | Leifeld | 19/288 X |
| 4,232,426 | 11/1980 | Beneke et al. . | |
| 4,272,866 | 6/1981 | Vollrath | 19/150 |
| 4,275,482 | 6/1981 | Leifeld | 19/150 |

FOREIGN PATENT DOCUMENTS

| | | |
|---|---|---|
| 1091010 | 4/1961 | Fed. Rep. of Germany . |
| 1292049 | 4/1969 | Fed. Rep. of Germany . |
| 1510428 | 1/1974 | Fed. Rep. of Germany . |
| 2836979 | 3/1980 | Fed. Rep. of Germany . |
| 586167 | 3/1925 | France . |
| 740910 | 11/1955 | United Kingdom . |
| 914049 | 12/1962 | United Kingdom . |
| 1046197 | 10/1966 | United Kingdom . |
| 1051990 | 12/1966 | United Kingdom . |
| 1338441 | 11/1973 | United Kingdom . |
| 2056513 | 3/1981 | United Kingdom . |

*Primary Examiner*—Louis K. Rimrodt
*Assistant Examiner*—J. S. Olds
*Attorney, Agent, or Firm*—Spencer & Frank

[57] ABSTRACT

An apparatus for gathering a running fiber web into a sliver, includes a web guide element having edge portions defining an outlet opening through which the web passes; a trumpet arranged downstream of the outlet opening of the web guide element as viewed in a direction of web advance, and an arrangement for guiding air, flowing against the direction of web advance and generated by web compression downstream of the web guide element, away from a zone extending between the outlet opening of the web guide element and the outlet opening of the trumpet.

9 Claims, 8 Drawing Figures

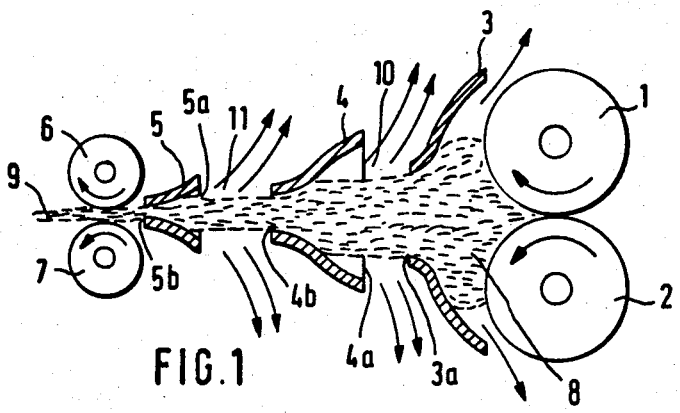
FIG.1
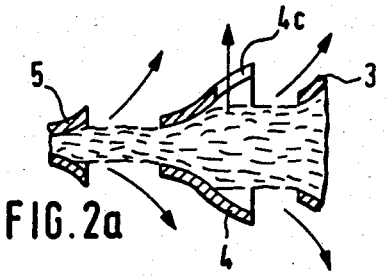
FIG.2a
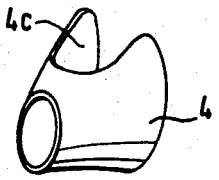
FIG. 2b
FIG.3
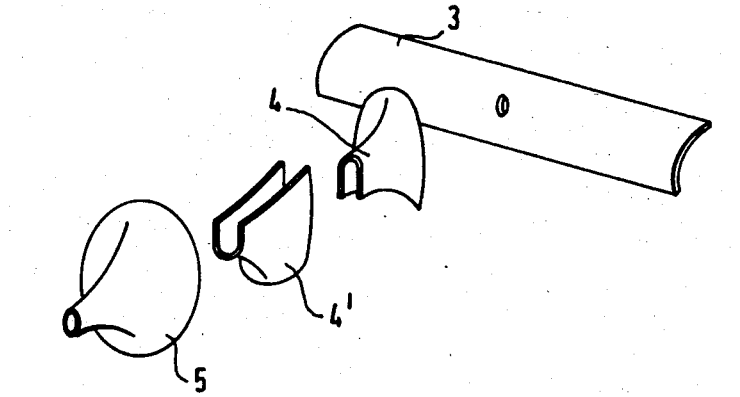

APPARATUS FOR GATHERING A FIBER WEB INTO A SLIVER IN A CARDING MACHINE

BACKGROUND OF THE INVENTION

This invention relates to an apparatus for gathering a fiber web, discharged by a web delivering device of a card, into a sliver, including the step of passing the fiber web through an opening in a fiber web guide element and introducing the gathered fiber web into a trumpet.

According to a known method, the gathered fiber web is introduced from the opening in the fiber web guide element directly into the trumpet and leaves the trumpet as a sliver. Upon increasing the delivery speed of the card, for example, to a web speed of 300 m/min., operational disturbances are experienced due to an air backflow at the trumpet. Further, immediately upstream of the trumpet (as viewed in the direction of fiber travel) the fiber web takes up a significantly greater space than the compressed sliver. The environmental air is entrained by the fiber web into the trumpet; the entrained air quantities increase with increasing speed. The air streaming rearwardly from the trumpet, particularly from its constriction, eventually reaches such a high backflow speed that the incoming fiber web is destroyed or is blown back in several zones. If the fiber web is compressed from a large cross section in the trumpet, the backflow velocities were found to be excessively high in case of web speeds above 100 m/min.

SUMMARY OF THE INVENTION

It is an object of the invention to provide an improved apparatus of the above-outlined type by means of which the discussed disadvantages are eliminated and which thus allow a disturbance-free gathering of the fiber web particularly at high web speeds.

This object and others to become apparent as the specification progresses, are accomplished by the invention, according to which, briefly stated, the air which flows backwardly during the compression of the fiber web is guided away from between the opening in the fiber web guide element and the trumpet and/or the location of web entrance into the trumpet.

By virtue of guiding away the backflowing air, an accumulation of air in front of the trumpet is prevented and thus a disturbing influence of eddy effects on the fiber web or the pre-densified sliver is avoided. It is thus of importance that the air be removed from the zone—as a rule, the central or mid-zone—where the fiber web is gathered and densified. In this manner, web speeds in excess of 250 m/min. may be achieved for a substantial operational period without experiencing fiber web breakage. Further, fiber webs in the very fine number range, such as an Nm 0.35 may be processed without difficulties. At the same time, dust and short fibers are removed with the air. The method according to the invention is advantageously utilized even in case of lesser fiber web speeds, for example, speed under 180 m/min. The invention ensures that a zone-wise blowback of the fiber web is eliminated and a breakage of the fiber web in these zones and thus a disadvantageous effect on the uniformity of the fiber web are prevented.

The apparatus according to the invention includes an aperture which maintains communication between the ambient atmosphere or an evacuation device and the zone which extends from the outlet opening of the fiber web guide element to the entrance of the trumpet. In this manner, together with the air to be drawn off, dust and short fibers are also eliminated. Expediently, the zone between the outlet opening in the fiber web guide element and the entrance of the trumpet are open in successive zones. In case the fiber web is densified in at least two, but preferably in more successive stages, the web reaches the consecutive trumpet devices with a reduced volume, that is, with lesser air per time unit. In this manner the backflow velocity is reduced to a magnitude at which no operational disturbances occur.

Preferably, between the opening in the fiber web guide element and the trumpet there is arranged at least one trumpet-shaped guide element. Expediently, the cross section of the outlet area of each trumpet-shaped guide element is smaller than the cross section of the inlet area of the respective, downstream-arranged trumpet-shaped guide element or the fiber trumpet. According to a further feature of the invention, the trumpet-shaped guide element is at least partially open.

BRIEF DESCRIPTION OF THE DRAWING

FIG. 1 is a schematic sectional side elevational view of a preferred embodiment of the invention.

FIG. 2*a* is a schematic sectional side elevational view of another preferred embodiment of the invention.

FIG. 2*b* is a perspective view of a component of the embodiment shown in FIG. 2*a*.

FIG. 3 is a schematic perspective exploded view of a further preferred embodiment of the invention.

DESCRIPTION OF THE PREFERRED EMBODIMENTS

Figure 4:
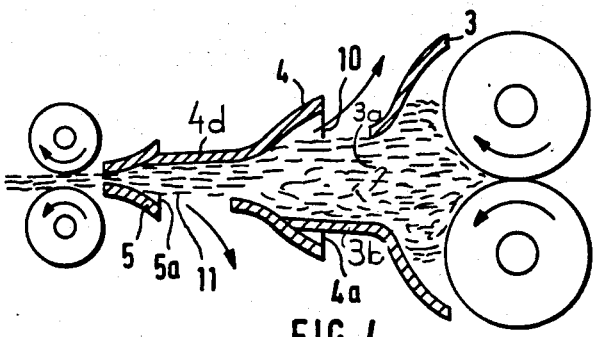
FIG. 4 is a schematic sectional side elevational view of still another preferred embodiment of the invention.

Turning now to FIG. 1, there are illustrated two crushing rollers 1 and 2 which are supported in a carding machine (not illustrated) and which form the web delivering device thereof. Immediately downstream of the crushing rollers 1 and 2 there is arranged a fiber web guide element 3 (of the type disclosed, for example, in German Pat. No. 2,711,619), a trumpet-shaped guide element 4, a fiber web trumpet 5 and calender rollers 6 and 7. The opening 3*a* in the fiber web guide element 3 is smaller than the entrance opening 4*a* of the trumpet-like guide element 4 whose outlet opening 4*b*, in turn, is smaller than the entrance opening 5*a* of the trumpet 5. The zones between the outlet opening 3*a* and the entrance opening 4*a* as well as between the outlet opening 4*b* and the entrance opening 5*a* are discontinuities (openings) 10 and 11 which communicate with the ambient surrounding air.

In operation, the fiber web 8 delivered by the crushing rollers 1 and 2 is gathered by the fiber web guide element 3 and thereafter passed through the opening 3*a* and is admitted, as a pre-compressed fiber material, into the trumpet-like guide element 4 and therefrom it is introduced into the fiber trumpet 5 from which it is drawn by the calender rollers 6 and 7 as a sliver 9. Thus, the fiber web is densified in several stages. By gathering the material by the fiber web guide element 3 and upon passage through the opening 3*a* the fiber web 8 is first pre-compressed. Thereafter, a more pronounced densification takes place in the trumpet-like guide element 4 whereupon eventually the final densification occurs in the trumpet 5 from which the sliver emerges. During the compression (densification) of the sliver 9 in the trumpet 5 air is liberated which streams backwardly in the direction of the entrance opening 5*a* and enters into the ambient atmosphere through the aperture 11. One part of the backflowing air may enter the fiber material and thus may slightly inflate the same. The trumpet-like guide element 4 therefore also has the purpose to hold together the pre-compressed fiber material. A further purpose of the trumpet-like guide element 4 is to additionally compress the fiber material which leaves the opening 3*a*. Air which passes through the entrance opening 4*a* during this process is guided away through the aperture 10.

Turning now to FIGS. 2*a* and 2*b*, the trumpet-like guide element 4 has an opening 4*c* in its wall, that is, the wall is partially open, starting from the entrance opening 4*a*. By virtue of the opening 4*c*, a greater quantity of backflowing air may be guided away from the trumpet-like guide element 4. Further, by virtue of the opening 4*c* it is feasible to predetermine the direction of air removal (upward, in the embodiment shown in FIGS. 2*a* and 2*b*).

Turning now to FIG. 3, between the fiber web guide element 3 and the trumpet 5 there are provided two trumpet-like guide elements 4 and 4'. The guide element 4 is fully open in the downward direction whereas the guide element 4' is fully open in an upwardly oriented direction.

Figure 4A:
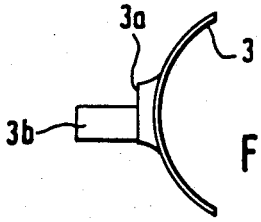
FIG. 4*a* is a schematic side elevational view of one part of the structure shown in FIG. 4.

Turning now to FIG. 4, there is illustrated a preferred embodiment wherein the zones between the opening 3*a* of the fiber web guide element 3 and the entrance opening 5*a* of the trumpet 5 are only partially open as indicated at 10' and 11'. One part of the edge defining the opening 3*a* has an upwardly open extension 3*b* (also see FIG. 4*a*) which projects partially into the entrance opening 4*a* of the trumpet-like guide element 4. The terminal edge of the extension 3*b* partially contacts and seals the inner face of the trumpet-like guide element 4 along its lower zone as viewed in FIG. 4. In the upward direction no such contacting takes place, whereby the opening 10' is formed. One part of the edge defining the outlet opening 4*b* has an extension 4*d* projecting into the entrance opening 5*a* of the trumpet 5, whereby the terminal edge of the extension 4*d* partially contacts and seals the inner face of the trumpet 5 along its upper zone, as viewed in FIG. 4. In the downward direction no such contacting takes place whereby the opening 11' is formed.

Figure 5:
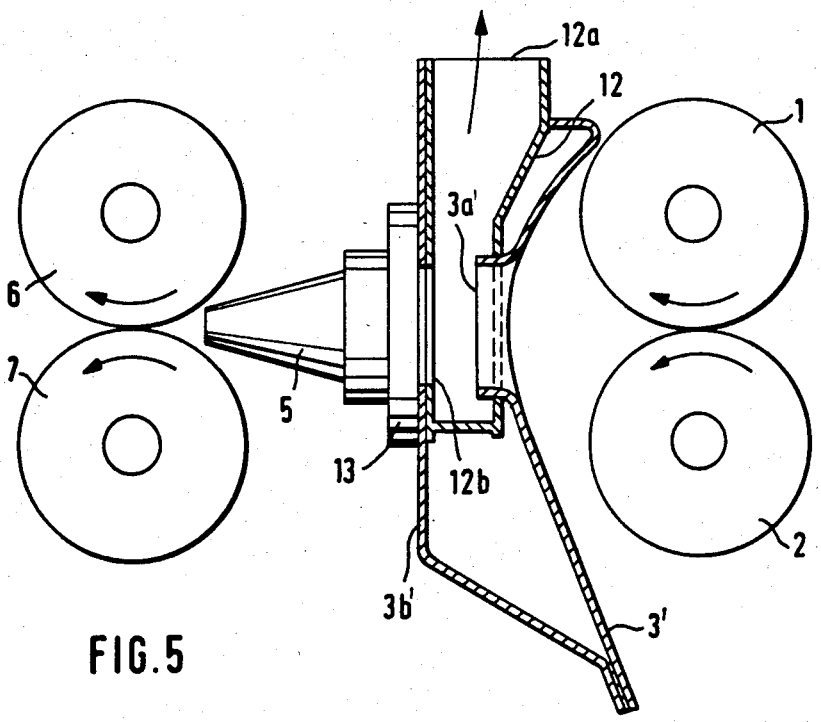
FIG. 5 is a schematic side elevational view of another preferred embodiment of the invention.

Turning now to FIG. 5, downstream of the crushing rollers 1 and 2 there is arranged a fiber web guide element 3' of the type disclosed in U.S. Pat. No. 4,272,866. The opening 3*a'* of the guide element 3' is slightly bent and reaches into a guide element 12 which is a generally U-shaped sheet metal component. The outlet zone 12*b* of the guide element 12 is obturated by a cover 3*b'*. The guide element 12 has an upwardly oriented opening 12*a*. To the end of the guide element 12 there is mounted, with the intermediary of a disc 13, the trumpet 5 followed downstream by the calender rollers 6 and 7. The opening 12*a* serves for guiding away the backflowing air emanating from the trumpet 5. A contacting of the pre-compressed fiber material is thus not effected by the guide element 12. The edge defining the opening 3*a'* may have an extension similarly to the structure shown in FIG. 4*a* and it is also feasible that a like extension projects into the entrance opening 5*a* of the trumpet 5. In this embodiment, the pre-compressed material leaving the opening 3*a'* is supported from below by the cover 3*b'*.

Figure 6:
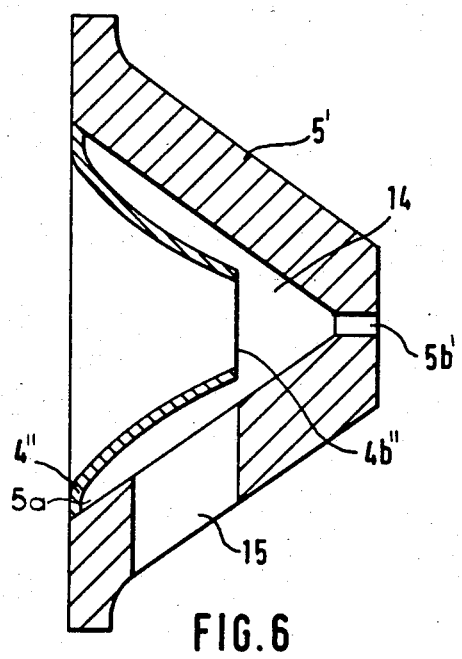
FIG. 6 is a schematic sectional side elevational view of another preferred embodiment of the invention.

In FIG. 6 there is illustrated a trumpet-shaped guide element 4'' which is inserted into the entrance opening 5*a'* of the trumpet 5' in such a manner that an intermediate space 14 having the configuration of a truncated cone jacket is formed between the outer surface of the trumpet-like guide element 4'' and the inner surface of the trumpet 5'. The intermediate space 14 communicates with the outlet opening 5*b'* of the trumpet 5'. Thus, the entrance openings of the trumpet-like guide element 4'' and the trumpet 5' merge into one another. The intermediate space 14 is sealed in the zone of the contact between the trumpet-like guide element 4'' and the trumpet 5'. In the lower wall zone of the trumpet 5' there is provided a throughgoing opening 15 which connects the intermediate space 14 with a vacuum device (not shown) and which functions as an air sluice. The opening 15 is arranged between the entrance opening 5*a'* of the trumpet 5' and the outlet opening 4*b''* of the trumpet-like guide element 4'' in such a manner that it is shielded by the latter, so that no fiber material may be introduced into the opening 15.

It will be understood that the above description of the present invention is susceptible to various modifications, changes and adaptations, and the same are intended to be comprehended within the meaning and range of equivalents of the appended claims.

What is claimed is:

1. In an apparatus for gathering a running fiber web into a sliver, including a web guide element having edge portions defining an outlet opening through which said web passes; and a trumpet situated downstream of said outlet opening of said web guide element as viewed in a direction of web advance, said trumpet having an entrance opening and an outlet opening and being arranged for compressing said fiber web, the improvement comprising pre-compressing means situated upstream of said trumpet at a distance therefrom for pre-compressing said fiber web prior to its introduction into the entrance opening of said trumpet; said web guide element comprising said pre-compressing means; further comprising at least one trumpet-shaped guide member situated between said outlet opening of said guide element and said trumpet; each trumpet-shaped guide member comprising said pre-compressing means, whereby said pre-compressing means is multi-stage; and guiding means for guiding air, flowing against said direction of web advance and generated by web compression by said trumpet, away from a zone extending between said pre-compressing means and said outlet opening of said trumpet.

2. An apparatus as defined in claim 1 wherein said guiding means comprises means defining a directional opening situated between said outlet opening of said web guide element and said entrance opening of said trumpet.

3. An apparatus as defined in claim 1, wherein said trumpet and each trumpet-shaped guide member has an entrance opening and an outlet opening each defining a cross-sectional area; one trumpet-shaped guide member adjoining said trumpet; and further wherein the cross-sectional area of the outlet opening of the trumpet-shaped guide member adjoining said trumpet is smaller than the cross-sectional area of said entrance opening of said trumpet and the cross-sectional area of the outlet of each trumpet-shaped member is smaller than the cross-sectional area of the entrance opening of a downstream adjoining trumpet-shaped member.

4. An apparatus as defined in claim 1, wherein each trumpet-shaped member has a wall; said guiding means comprises an opening formed in one part of the wall of at least one said trumpet-shaped member.

5. An apparatus as defined in claim 1, wherein said trumpet has a wall; said guiding means comprises means defining at least one lateral throughgoing opening in said wall.

6. An apparatus as defined in claim 1, further comprising at least two adjoining trumpet-shaped guide members situated between said outlet opening of said guide element and said trumpet; wherein each trumpet-shaped guide member has a wall and a length measured parallel to the direction of web advance; said guiding means comprising an opening formed in the wall of each trumpet-shaped member; the opening extending along the entire length of each said trumpet-shaped member, whereby each trumpet-shaped member being laterally fully open; openings of adjoining said trumpet-shaped guide members being oriented in opposite directions.

7. In an apparatus for gathering a running fiber web into a sliver, including a web guide element having edge portions defining an outlet opening through which said web passes; and a trumpet arranged downstream of said outlet opening of said web guide element as viewed in a direction of web advance, said trumpet having an entrance opening and an outlet opening, the improvement comprising guiding means for guiding air, flowing against said direction of web advance and generated by web compression downstream of said web guide element, away from a zone extending between said outlet opening of said web guide element and said outlet opening of said trumpet; further comprising a trumpet-shaped guide member situated between said outlet opening of said web guide element and said trumpet and having an inlet opening and edge portions defining an outlet opening; said edge portions of said web guide element including an extension projecting into said inlet opening of said trumpet-shaped guide member and being in contact therewith; said edge portions of said trumpet-shaped guide member including an extension projecting into said entrance opening of said trumpet and being in contact therewith; a first lateral opening defined between said edge portions of said web guide element and said trumpet-shaped guide member and a second lateral opening defined between said edge portions of said trumpet-shaped guide member and said trumpet; said first and second lateral openings being oppositely oriented and forming part of said guiding means for guiding air.

8. In an apparatus for gathering a running fiber web into a sliver, including a web guide element having edge portions defining an outlet opening through which said web passes; and a trumpet arranged downstream of said outlet opening of said web guide element as viewed in a direction of web advance, said trumpet having an entrance opening and an outlet opening, the improvement comprising guiding means for guiding air, flowing against said direction of web advance and generated by web compression downstream of said web guide element, away from a zone extending between said outlet opening of said web guide element and said outlet opening of said trumpet; further comprising a cover attached to said web guide element and connected to said trumpet; said cover defining a lateral opening communicating with a space between said web guide element and said trumpet; said lateral opening forming part of said guiding means for guiding air.

9. In an apparatus for gathering a running fiber web into a sliver, including a web guide element having edge portions defining an outlet opening through which said web passes; and a trumpet arranged downstream of said outlet opening of said web guide element as viewed in a direction of web advance, said trumpet having an entrance opening and an outlet opening, the improvement comprising guiding means for guiding air, flowing against said direction of web advance and generated by web compression downstream of said web guide element, away from a zone extending between said outlet opening of said web guide element and said outlet opening of said trumpet; further comprising a trumpet-shaped guide member accommodated within said trumpet and said trumpet having a lateral opening shielded by said trumpet-shaped guide member; said lateral opening forming part of said guiding means for guiding air.

* * * * *